US010829964B2

(12) United States Patent
Kimura

(10) Patent No.: US 10,829,964 B2
(45) Date of Patent: Nov. 10, 2020

(54) VEHICULAR DOOR LATCH DEVICE

(71) Applicant: MITSUI KINZOKU ACT CORPORATION, Yokohama (JP)

(72) Inventor: Shuntaro Kimura, Yokohama (JP)

(73) Assignee: Mitsui Kinzoku Act Corporation, Yokohama (JP)

( * ) Notice: Subject to any disclaimer, the term of this patent is extended or adjusted under 35 U.S.C. 154(b) by 506 days.

(21) Appl. No.: 15/719,414

(22) Filed: Sep. 28, 2017

(65) Prior Publication Data

US 2018/0094460 A1 Apr. 5, 2018

(30) Foreign Application Priority Data

Sep. 30, 2016 (JP) ..... 2016-194232

(51) Int. Cl.
*E05B 77/16* (2014.01)
*E05B 77/28* (2014.01)
(Continued)

(52) U.S. Cl.
CPC ..... *E05B 77/16* (2013.01); *E05B 77/24* (2013.01); *E05B 77/28* (2013.01); *E05B 81/06* (2013.01);
(Continued)

(58) Field of Classification Search
CPC ..... Y10T 292/1047; Y10T 292/1082; Y10T 292/108; Y10T 292/1075; Y10T 292/0945; Y10T 292/1076; Y10T 292/702; Y10T 292/1052; Y10T 292/1077; Y10T 292/1078; Y10T 292/308; Y10T 70/70; Y10T 70/7051; Y10T 70/7102; E05B 81/14; E05B 81/20; E05B 85/26; E05B 83/36; E05B 85/20; Y10S 292/23
See application file for complete search history.

(56) References Cited

U.S. PATENT DOCUMENTS 4,395,064 A * 7/1983 Bellot ..... E05B 81/20 292/201
5,516,164 A * 5/1996 Kobayashi ..... E05B 81/20 292/201
(Continued)

FOREIGN PATENT DOCUMENTS

JP 2016-053271 A 4/2016

*Primary Examiner* — Mark A Williams
(74) *Attorney, Agent, or Firm* — Knobbe, Martens, Olson & Bear, LLP

(57) ABSTRACT

A vehicular door latch device includes a latch, a ratchet, a locking and unlocking mechanism, and a rotation member. The latch rotates in accordance with closing of a door while a striker provided in a vehicle body is engaged. When the door is in a fully-closed state, the ratchet holds the latch in a first posture. When the door is in a half-closed state, the ratchet holds the latch in a second posture. The mechanism is switched between an unlocked posture that can cancel interlock, and a locked posture that cannot cancel the interlock. When the latch is in the second posture, the rotation member overlaps the switching route and prohibits the posture change. When coming into contact with the rotation member overlapping the switching route, the mechanism in the unlocked posture is switched to the unlocked posture by rotation of a portion thereof in contact with the rotation member.

7 Claims, 16 Drawing Sheets

(51) Int. Cl.

| | |
|---|---|
| ***E05B 81/14*** | (2014.01) |
| ***E05B 77/24*** | (2014.01) |
| ***E05B 81/16*** | (2014.01) |
| ***E05B 81/34*** | (2014.01) |
| ***E05B 85/24*** | (2014.01) |
| ***E05B 81/66*** | (2014.01) |
| ***E05B 81/06*** | (2014.01) |

(52) U.S. Cl.
CPC ..... *E05B 81/14* (2013.01); *E05B 81/16* (2013.01); *E05B 81/34* (2013.01); *E05B 81/66* (2013.01); *E05B 85/243* (2013.01)

(56) References Cited

U.S. PATENT DOCUMENTS

| | | | | |
|---|---|---|---|---|
| 5,639,130 | A * | 6/1997 | Rogers, Jr. | E05B 81/20 292/199 |
| 6,053,542 | A * | 4/2000 | Ostrowski | E05B 81/20 292/201 |
| 7,059,640 | B2 * | 6/2006 | Tensing | E05B 81/14 292/201 |
| 7,175,212 | B2 * | 2/2007 | Cetnar | E05B 81/20 292/201 |
| 9,810,004 | B2 * | 11/2017 | Scholz | E05B 81/14 |
| 9,874,046 | B2 * | 1/2018 | Wittelsbuerger | E05B 77/06 |
| 10,053,892 | B2 * | 8/2018 | Merget | E05B 85/26 |

* cited by examiner

OPEN POSITION

HALF LATCH POSITION

JUST-BEFORE-FULL LATCH POSITION

FULL LATCH POSITION

FULL LATCH POSITION IN UNLOCK STATE

FULL LATCH POSITION IN LOCKED STATE

HALF LATCH OR OPEN POSITION IN UNLOCK STATE

ABNORMAL STATE

UNLOCKING OPERATION IN ABNORMAL STATE

VEHICULAR DOOR LATCH DEVICE

INCORPORATION BY REFERENCE

The disclosure of Japanese Patent Application No. 2016-194232, filed on Sep. 30, 2016, is incorporated herein by reference.

BACKGROUND

The present disclosure relates to a vehicular door latch device.

For example, a vehicular door latch device disclosed in JP2016-53271A is as follows. That is, in the vehicular door latch device, when a detection lever which is shifted by rotating a latch that engages a striker on a vehicle body side is at a full latch position (a position corresponding to the fully-closed state of the door), a locking and unlocking mechanism can be switched from an unlocked state to a locked state. Further, in the vehicular door latch device, when the detection lever is at an open position (a position corresponding to the open state of the door), a portion of the detection lever advances into the movement trajectory of the locking and unlocking mechanism, and inhibits switching of the locking and unlocking mechanism from the unlocked state to the locked state.

However, in the vehicular door latch device, when an operation of closing the door and an operation of locking the locking and unlocking mechanism are carried out at almost the same time, while the detection lever is at the half latch position (a position corresponding to a half-closed state of the door), in some cases, there is a failure to prevent switching the locking and unlocking mechanism from the unlocked state to the locked state. As a result, there is a possibility that, while the detection lever is at the half latch position, the locking and unlocking mechanism will be switched from the unlocked state to the locked state.

SUMMARY

A first vehicle door latch device of the present disclosure includes a latch, a ratchet, a locking and unlocking mechanism, and a rotation mechanism. A groove inwardly recessed from the outer circumference thereof, a first interlock section, and a second interlock section are formed in the latch. The latch rotates in accordance with opening and closing of a door while a striker provided in a vehicle body engages the groove. The ratchet is disposed in contact with the latch. The ratchet interlocks with the first interlock section and holds the latch in a first posture when the door is in a fully-closed state. The ratchet interlocks with the second interlock section and holds the latch in a second posture when the door is in a half-closed state. The locking and unlocking mechanism is switched between an unlocked posture that can cancel interlock between the latch and the ratchet and a locked posture that cannot cancel the interlock, through an operation of an operation unit. The rotation mechanism is a rotation member which rotates as the latch rotates, while being in contact with the outer circumference. The rotation member is retracted from a posture switching route of the locking and unlocking mechanism so as to permit posture change of the locking and unlocking mechanism from the unlocked posture to the locked posture when the latch is in the first posture, and overlaps the switching route to prohibit the posture change of the locking and unlocking mechanism from the unlocked posture to the locked posture when the latch is in the second posture. When the locking and unlocking mechanism in the locked posture comes into contact with the rotation member overlapping the switching route, a portion, of the locking and unlocking mechanism in contact with the rotation member rotates and the locking and unlocking mechanism is switched to the unlocked posture.

A second vehicle door latch device of the present disclosure is based on the first vehicle door latch device. In the second vehicle door latch device, the locking and unlocking mechanism includes a contact member that is a portion configured to come into contact with the rotation member, and an urging member that urges the contact member against the rotation member. When coming into contact with the rotation member overlapping the switching route, the contact member slides relative to the rotation member and changes the posture thereof relative to the rotation member.

A third vehicle door latch device of the present disclosure is based on the second vehicle door latch device. With posture switching of the locking and unlocking mechanism from the locked posture to the unlocked posture, the contact member restores a normal posture by the urging force of the urging member.

A fourth vehicle door latch device of the present disclosure is based on the second vehicle door latch device. The locking and unlocking mechanism includes a holding member that holds the contact member, and the contact member is supported by a shaft in such a manner as to rotate by a predetermined angle relative to the holding member.

A fifth vehicle door latch device of the present disclosure is based on the first vehicle door latch device. In the fifth vehicle door latch device, a recessed and protruding section, which includes a protruding section protruding outwardly and a recessed section adjacent to the protruding section and which comes into contact with the rotation member, is formed in the outer circumference of the latch. The rotation member includes a first section which comes into contact with the recessed and protruding section and a second section which is provided on a side opposite to the first section with the rotation center of the rotation member interposed therebetween. When the latch is in the first posture, the rotation member brings the first section into contact with the recessed section to cause the second section to repeat from the switching route, and when the latch is in the second posture, the rotation member brings the first section into contact with the protruding section to cause the second section to overlap the switching route.

A sixth vehicle door latch device of the present disclosure is based on the first vehicle door latch device. In the sixth vehicle door latch device, the locking and unlocking mechanism is formed of a link mechanism.

A seventh vehicle door latch device of the present disclosure is based on the first vehicle door latch device. The seventh vehicle door latch device includes a detection unit that detects whether the rotation member overlaps the switching route, and a notification unit that issues, when a result detected by the detection unit is determined to be affirmative, a notification about the result.

DETAILED DESCRIPTION

Hereinafter, an embodiment of a vehicular door latch device of the present disclosure will be described with reference to the drawings.

Figure 1:
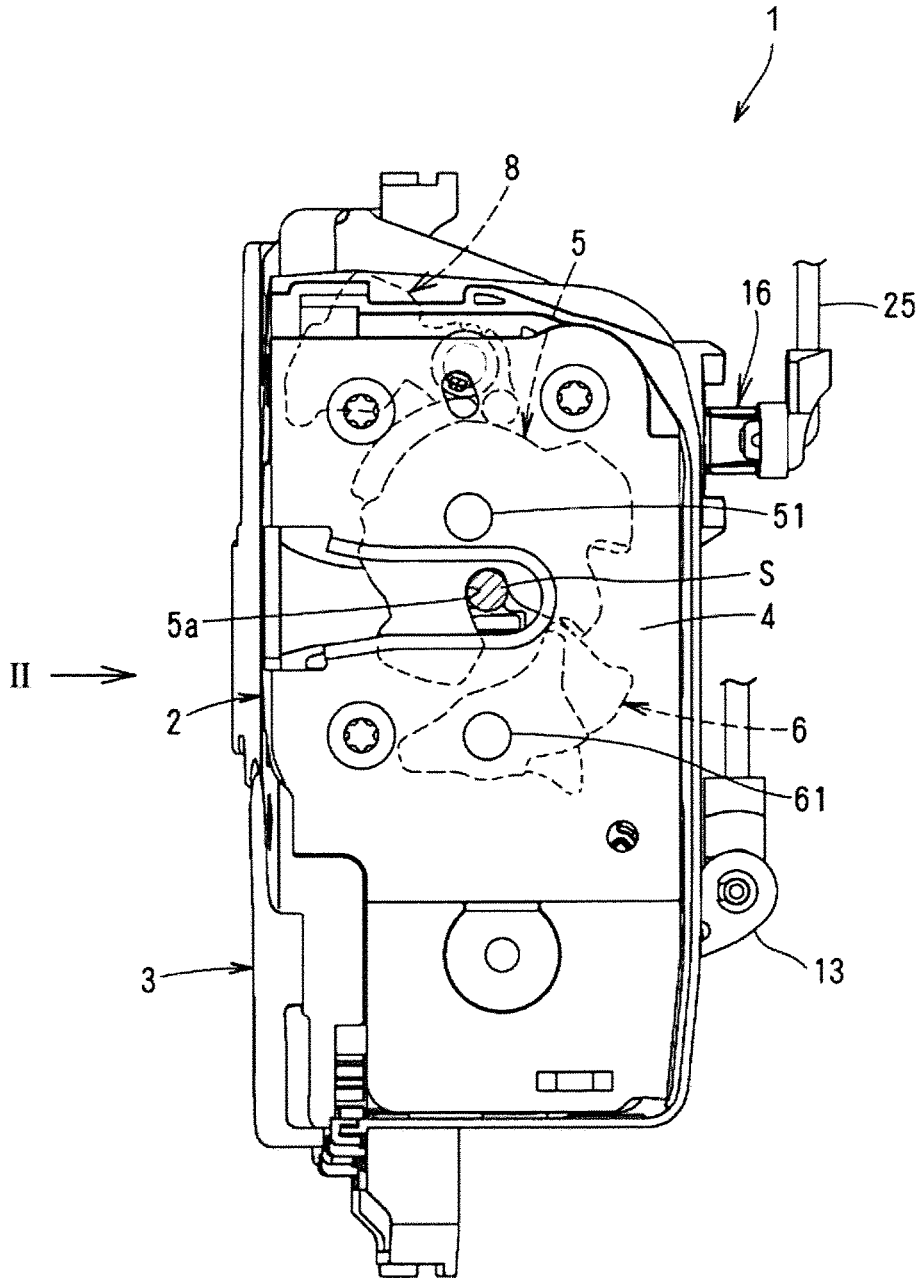
FIG. 1 is a front view of a vehicular door latch device of the present disclosure.
Figure 2:
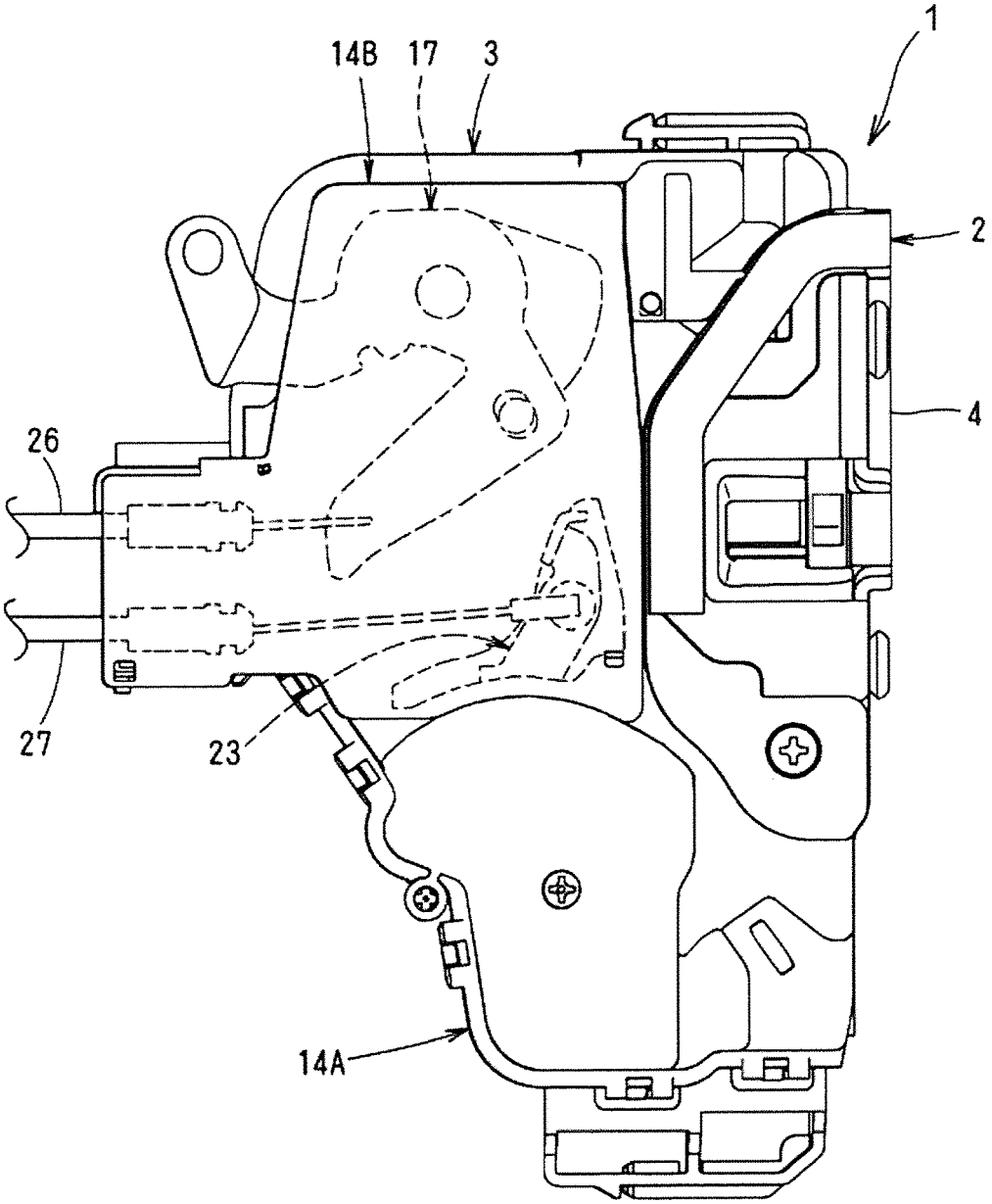
FIG. 2 is a side view from an arrow II direction in FIG. 1.
Figure 3:
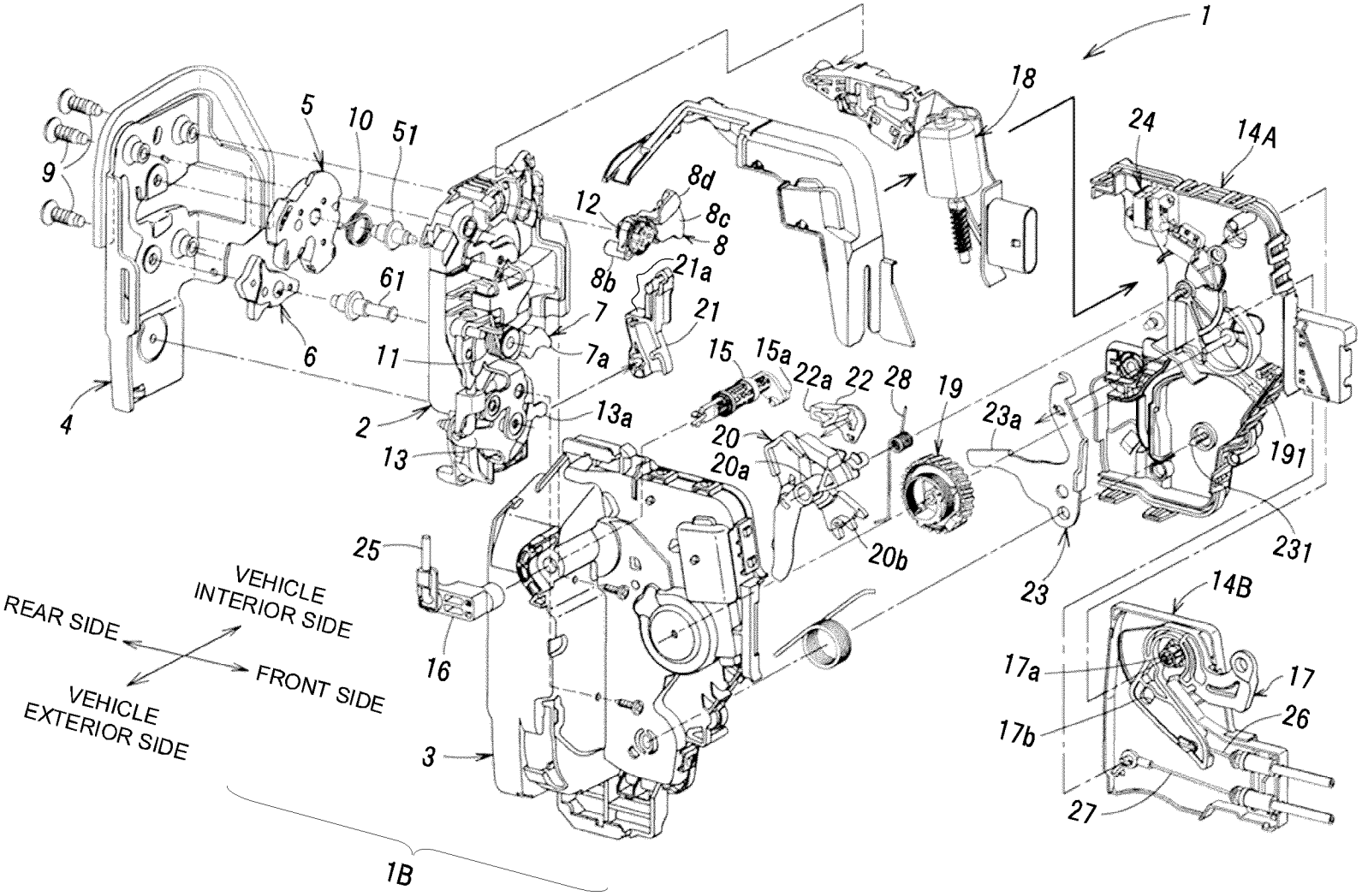
FIG. 3 is an exploded perspective view of the vehicular door latch device.

Here, FIG. 1 is a front view of vehicular door latch device 1. FIG. 2 is an arrow II view of FIG. 1. FIG. 3 is an exploded perspective view of vehicular door latch device 1. In the following explanation, directions in a case where vehicular door latch device 1 is mounted on a door (not illustrated) of a vehicle (not illustrated) are used (see FIGS. 1 to 16).

Overview of Vehicular Door Latch Device

Vehicular door latch device 1 is arranged on the rear end side in a front door (hereinafter, referred to as "door") whose front part is pivotally supported in an openable/closable manner about a vertically extending shaft. The phrase "is pivotally supported" herein means being supported in a rotatable manner about a predetermined shaft. As illustrated in FIGS. 1 to 3, vehicular door latch device 1 includes engagement unit 1A and operation unit 1B. Engagement unit 1A includes engagement mechanism housing 2 housing therein an engagement mechanism (described later) which holds the door in a fully-closed state by engaging with striker S (see FIG. 1) on the vehicle body side. Operation unit 1B includes operation mechanism housing 3 that houses therein locking and unlocking mechanism 40 (described later, see FIG. 3) and other components.

Engagement Unit

As illustrated in FIG. 3, engagement unit 1A includes an engagement mechanism formed of engagement mechanism housing 2, latch 5 engageable with striker S, and ratchet 6 engageable with latch 5. The engagement mechanism is disposed in engagement mechanism housing 2 (a space formed between engagement mechanism housing 2 and cover plate 4). As illustrated in FIG. 3, engagement unit 1A further includes open lever 7, detection lever 8 (an example of a rotation member), and outside lever 13. Engagement mechanism housing 2 is made from synthetic resin, and the rear surface thereof is covered and closed with metallic cover plate 4. Open lever 7 cancels the interlock between latch 5 and ratchet 6 (or a state where latch 5 and ratchet 6 are interlocked with each other, in other words, an interlock state). When the interlock between latch 5 and ratchet 6 is canceled, detection lever 8 becomes shiftable to a position corresponding to the rotation position of latch 5. Outside lever 13 is connected to an outside handle (not illustrated) for a door opening operation, which is provided on the vehicle exterior side of the door. Open lever 7, detection lever 8, and outside lever 13 are disposed on the front surface side of cover plate 4. Engagement mechanism housing 2 is fixed to the door with a plurality of bolts 9 such that cover plate 4 faces the inner surface of the door.

Overview of Operation Unit

As illustrated in FIG. 3, operation unit 1B includes operation mechanism housing 3, first key lever 15, second key lever 16, knob lever 17, electric motor 18, worm wheel 19, locking lever 20 (an example of a holding member), lift lever 21, movable lever 22 (an example of a portion to come into contact with the rotation member and an example of a contact member) supported by locking lever 20, inside lever 23 (an example of an operation part), and detection switch 24. Here, operation mechanism housing 3 is made from synthetic resin, and is fixed in front of engagement mechanism housing 2. A surface of operation mechanism housing 3, facing the vehicle interior side is covered and closed with main cover 14A which is made from synthetic resin and sub cover 14B which is fixed on a surface of main cover 14A, facing the vehicle interior side. First key lever 15 and second key lever 16 operate in conjunction with an operation of a key cylinder (not illustrated) for a locking and unlocking operation, which is disposed on the vehicle exterior side of the door. Knob lever 17 is connected to a lock knob (not illustrated) for a manual locking and unlocking operation, which is disposed on the vehicle interior side of the door. Electric motor 18 can be driven through a remote locking and unlocking operation of a mobile device (for example, a remote control key for locking the vehicular door, not illustrated). Worm wheel 19 rotates by driving electric motor 18. Locking lever 20 and lift lever 21 each can move to an unlocked position for enabling a door opening operation on the outside handle (not illustrated) and a locked position for preventing the door opening operation. Movable lever 22 is supported by locking lever 20. Inside lever 23 is connected to an inside handle (not illustrated) for a door opening operation, which is disposed on the vehicle interior side of the door. Detection switch 24 detects the rotation position of latch 5 though detection lever 8 so as to perform on/off switching. First key lever 15, second key lever 16, knob lever 17, electric motor 18, worm wheel 19, locking lever 20, lift lever 21, movable lever 22 supported by locking lever 20, inside lever 23, and detection switch 24 are disposed on the vehicle interior side in operation mechanism housing 3. The term "rotation" herein means swinging around a predetermined shaft within a predetermined angle range.

In the present embodiment, a configuration including at least movable lever 22, locking lever 20, and lift lever 21 in operation unit 1B is defined as locking and unlocking mechanism 40 (see FIG. 3). Movable lever 22, locking lever 20, and lift lever 21 form a so-called link mechanism (see FIGS. 11 to 15). Various modifications of the configuration of locking and unlocking mechanism 40 can be made according to the type of a vehicle to which vehicular door latch device 1 of the present embodiment is applied. The configuration is not limited to those similar to that of the present embodiment. Operation unit 1B will be described in detail later.

The term "locked state" herein means a state where the door cannot be opened from the outside of the vehicle even when locking lever 20 and lift lever 21 are at the locked position and a door opening operation is performed on the outside handle and the inside handle. The term "unlocked state" herein means a state where locking lever 20 and lift lever 21 are at the unlocked position and the door can be opened through an operation on the outside handle or the inside handle. In the present embodiment, a door opening operation is performed by using the outside handle.

Latch

Figure 4:
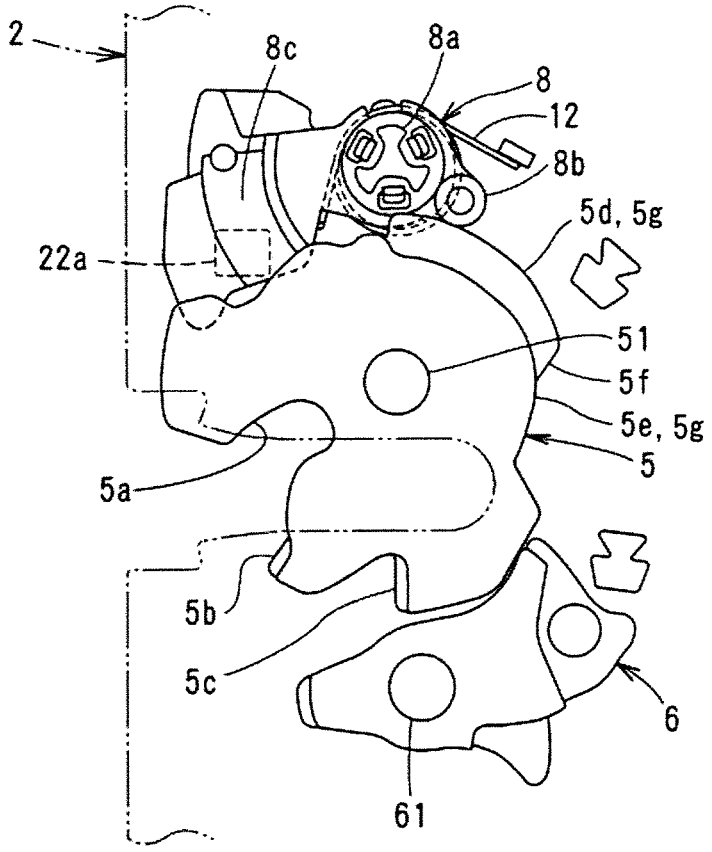
FIG. 4 is a front view of the main part of an engagement unit when a latch is at an open position.
Figure 5:
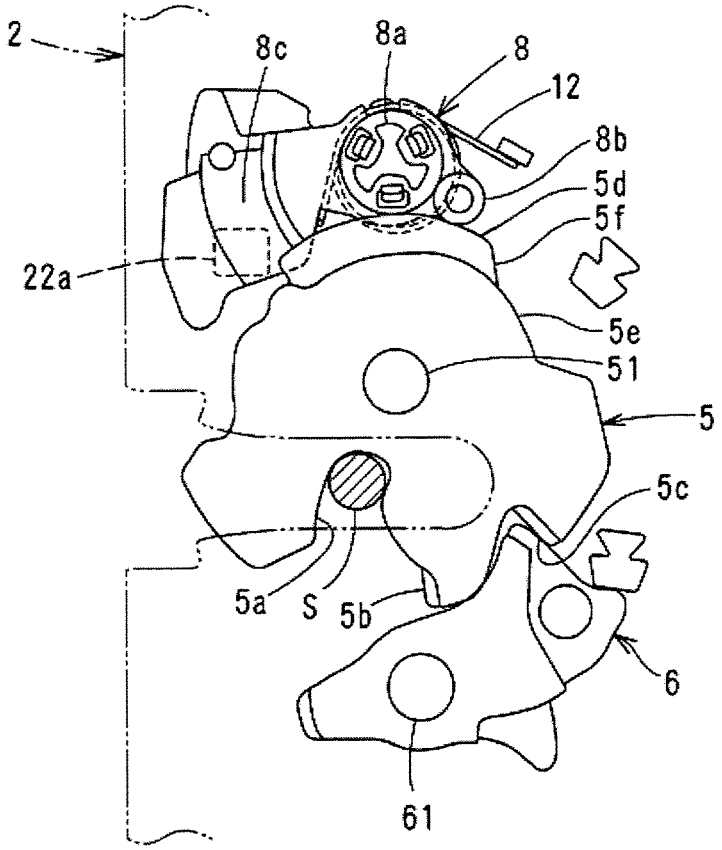
FIG. 5 is a front view of the main part of the engagement unit when the latch is at a half latch position.
Figure 6:
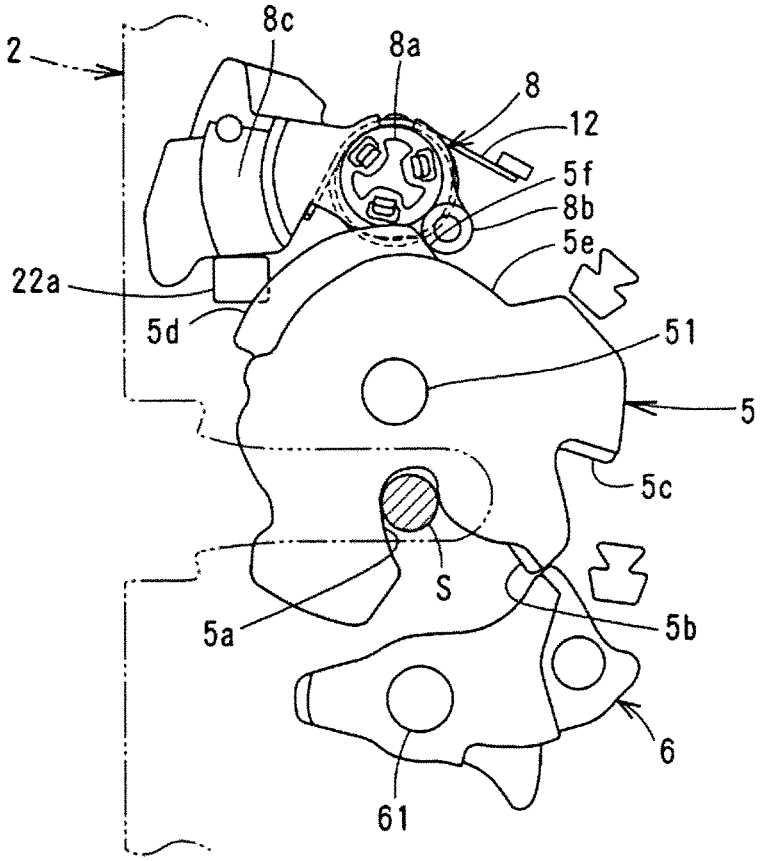
FIG. 6 is a front view of the main part of the engagement unit when the latch is at a just-before-full latch position.
Figure 7:
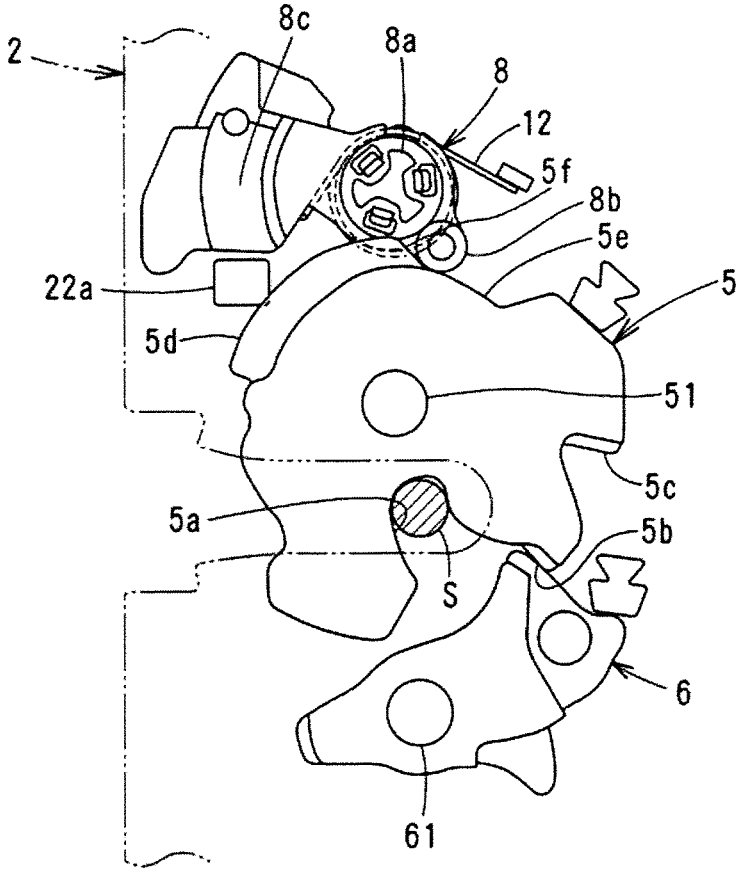
FIG. 7 is a front view of the main part of the engagement unit when the latch is at a full latch position.
Figure 8:
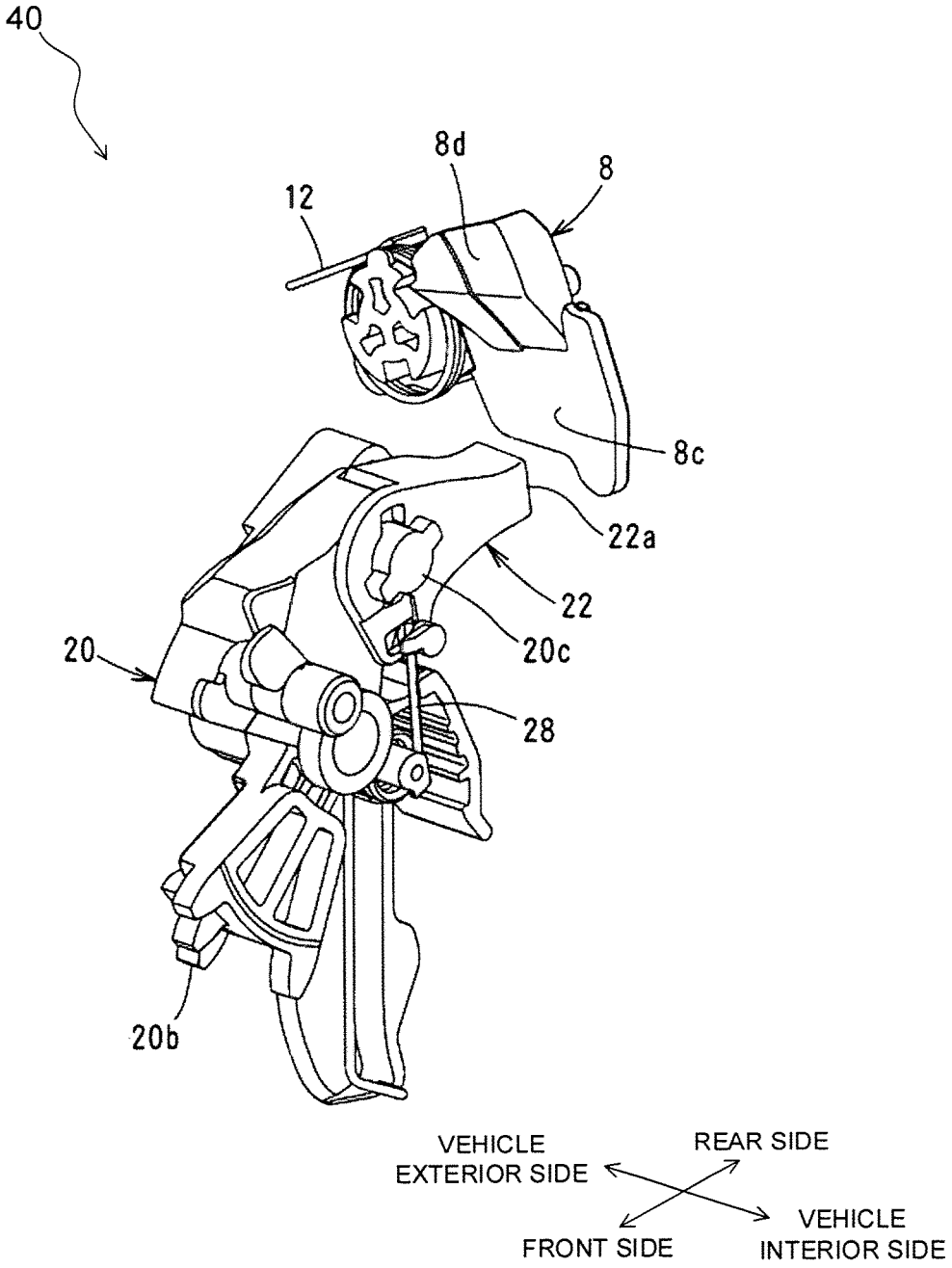
FIG. 8 is an enlarged perspective view of the relationship among a detection lever, a locking lever, and a movable lever.

Latch 5 has a function of rotating about a predetermined shaft with striker S being engaged with latch 5 (see FIGS. 1, 5, 6, and 7). FIGS. 4 to 7 are front views each illustrating a main part of engagement unit 1A. FIG. 4 is the front view of the main part of engagement unit 1A in a case where latch 5 is at the open position (a position corresponding to the open state of the door). FIG. 5 is the front view of the main part of engagement unit 1A in a case where latch 5 is at the half latch position (a position corresponding to the half-closed state of the door). FIG. 6 is the front view of the main part of engagement unit 1A in a case where latch 5 is at a just-before-full latch position (a position just before the door enters the fully-closed state). FIG. 7 is the front view of the main part of engagement unit 1A in a case where latch 5 is at the full latch position (a position corresponding to the fully-closed state of the door).

As illustrated in FIG. 3, latch 5 is pivotally supported by latch shaft 51 extending in the front/rear direction in engagement mechanism housing 2. The outer circumference of latch 5 has engagement groove 5*a* which is recessed inwardly from the outer circumference and with which striker S can engage, full latch interlock section 5*b*(an example of a first interlock section) with which ratchet 6 can engage from below, half latch interlock section 5*c* (an example of a second interlock section), protruding section 5*d* radially raised (in other words, outwardly protruding) from the outer circumference edge, and recessed section 5*e* which is adjacent to protruding section 5*d* and which is radially recessed from protruding section 5*d*. In the following description, a combined portion of protruding section 5*d* and recessed section 5*e* is referred to as protruding and recessed section 5*g*.

With a door closing operation, latch 5 is rotated by a determined angle from the open position illustrated in FIG. 4 toward a direction counterclockwise when viewed from the front side, against an urging force of spring 10 (see FIG. 3) applied to latch 5. Next, with the door closing operation, latch 5 rotates so as to pass the half latch position illustrated in FIG. 5, where striker S is slightly engaged with engagement groove 5*a*, pass the just-before-full latch position illustrated in FIG. 6, and reach the full latch position illustrated in FIG. 7 where latch 5 fully engages striker S. With a door opening operation, latch 5 rotates in accordance with a reverse operation of the aforementioned door closing operation. The just-before-full latch position means a position just before ratchet 6 engages half latch interlock section 5*c* (see FIG. 6).

Protruding section 5*d* of latch 5 is formed into a circular arc shape, the center of which is latch shaft 51 serving as a shaft about which latch 5 rotates, and outwardly protrudes within a predetermined angle range in the circumferential direction.

Ratchet

Ratchet 6 is pivotally supported by ratchet shaft 61 extending in the front/rear direction in engagement mechanism housing 2. Ratchet 6 is urged in an interlock direction (a counterclockwise direction in FIGS. 4 to 7) by spring 11 (see FIG. 3) urging open lever 7, and thus, is in contact with the outer circumference of latch 5. As illustrated in FIG. 5, when latch 5 rotates from the open position toward a closing direction (the counterclockwise direction in FIG. 4), ratchet 6 interlocks with half latch interlock section 5*c* and holds latch 5 at the half latch position. As illustrated in FIG. 7, when latch 5 further rotates from the half latch position toward the closing direction, ratchet 6 interlocks with full latch interlock section 5*b* and holds latch 5 at the full latch position.

The open position of latch 5 means a position corresponding to the open state of the door, where striker S does not engage engagement groove 5*a* (see FIG. 4). The half latch position means a position corresponding to the half-closed state of the door, where ratchet 6 engages half latch interlock section 5*c* (see FIG. 5). The full latch position means a position corresponding to the fully-closed state of the door where ratchet 6 engages with full latch interlock section 5*b* (see FIG. 7). Herein, the posture of latch 5 at the open position is referred to as a first posture, and the posture of latch 5 at the half latch position is referred to as a second posture.

A region from the open position to the just-before-full latch position of latch 5 is herein referred to as an open region. A region from the half latch position to the just-before-full latch position of latch 5 is referred to as a half latch region.

In the half latch region, a region closer to the half latch position than the just-before-full latch position is referred to as a half-latch closer side region. In the half latch region, a region closer to the full latch position from the just-before-full latch position is referred to as a full-latch closer side region.

Open Lever

As illustrated in FIG. 3, open lever 7 is pivotally supported, on the front surface of engagement mechanism housing 2, in an integrally rotatable manner with ratchet 6. Open lever 7 extends from the vehicle exterior side to the vehicle interior side. An end of open lever 7, at the vehicle interior side is provided with arm-like cancel receiving section 7*a*.

Detection Lever

As illustrated in FIGS. 3 to 7, detection lever 8 is pivotally supported by shaft section 8*a* extending in the front/rear direction in the upper portion of engagement mechanism housing 2. Detection lever 8 is urged by spring 12, toward a counterclockwise direction in FIGS. 4 to 7. Detection lever 8 has, at an end thereof, columnar sliding section 8*b* (an example of a first section) passing through a long hole (not illustrated) provided in the upper portion of engagement mechanism housing 2 so as to come into contact with protruding and recessed section 5*g* (recessed section 5*e* and protruding section 5*d*) of latch 5. Detection lever 8 has, at the other end thereof, planner inhibiting section 8*c* (an example of a second section) and raised section 8*d* above inhibiting section 8*c*.

With rotation of latch 5, sliding section 8*b* causes protruding and recessed section 5*g* (recessed section 5*e* and protruding section 5*d*) to relatively slide ("rotate", from another viewpoint) in the circumferential direction. As illustrated in FIG. 4, when latch 5 is in the open region, sliding section 8*b* is located at a position to ride on protruding section 5*d*. As illustrated in FIG. 5, when latch 5 is in the half-latch closer side region of the half latch region, sliding section 8*b* is located at a position to ride on protruding section 5*d* of latch 5 or to have slightly fallen from protruding section 5*d* toward inclined section 5*f* (an inclined surface connecting protruding section 5*d* to recessed section 5*e*). As illustrated in FIG. 6, when latch 5 is in the full-latch closer side region of the half latch region, sliding section 8*b* is located at a position to slightly ride on inclined section 5*f*. As illustrated in FIG. 7, when latch 5 is at full latch position, sliding section 8*b* is located at a position to have fallen into the recessed section 5*e*. In the present embodiment, a switching point from the half-latch closer side region to the full-latch closer side region and a switching point from the full-latch closer side region to the half-latch closer side region in the half latch region of latch 5, are set at the intermediate point between the half-latch closer side region and the full-latch closer side region.

As described above and as illustrated in FIGS. 4 and 5, when latch 5 is in the half-closer side region, inhibiting section 8*c* of detection lever 8 advances into movement trajectory L (see FIG. 9) (a side closer to movable lever 22 than one-dot chain line L when viewed from the front), along which the leading end of movable lever 22 moves with rotation of locking lever 20 about shaft section 20*a*. As a result, when latch 5 is in the half-latch closer side region, inhibiting section 8*c* inhibits movement of locking lever 20 from the unlocked position to the locked position via movable lever 22. In other words, when detection lever 8 is at the half latch position, inhibiting section 8*c* overlaps movement trajectory L (a posture switching route of locking and unlocking mechanism 40) of movable lever 22. As a result, when detection lever 8 is at the half latch position, inhibiting section 8*c* of detection lever 8 prohibits locking and unlocking mechanism 40 from changing from the unlocked position to the locked position.

In contrast, as illustrated in FIG. 6, when latch 5 is in the full-latch closer side region of the half latch region, inhibiting section 8*c* of detection lever 8 is retracted to the outside of movement trajectory L (a side opposite to the side closer to movable lever 22 than one-dot chain line L when viewed from the front). As a result, when latch 5 is in the full-latch closer side region, inhibiting section 8*c* permits movement of locking lever 20 from the unlocked position to the locked position. In other words, when detection lever 8 is in the full latch position, inhibiting section 8*c* is retracted from movement trajectory L (the posture switching route of locking and unlocking mechanism 40) of movable lever 22. As a result, when detection lever 8 is at the full latch position, inhibiting section 8*c* of detection lever 8 permits posture change of locking and unlocking mechanism 40 from the unlocked posture to the locked posture.

Outside Lever

Outside lever 13 rotates with a door opening operation of the outside handle (not illustrated). When locking and unlocking mechanism 40 is in the unlocked state, outside lever 13 pushes open lever 7 by rotation of outside lever 13 involved with the door opening operation, rotates open lever 7, and thereby, cancels the interlock between ratchet 6 and latch 5. As a result, when locking and unlocking mechanism 40 is in the unlocked state, the door can be opened by a driver, for example.

In contrast, during the locked state of the locking and unlocking mechanism, even when outside lever 13 is rotated by the door opening operation, outside lever 13 fails to hit open lever 7, and thus, cannot push open lever 7. Accordingly, when the locking and unlocking mechanism is in the locked state, outside lever 13 cannot cancel the interlock between ratchet 6 and latch 5. As a result, when locking and unlocking mechanism 40 is in the locked state, the door cannot be opened by a driver, for example.

Figure 11:
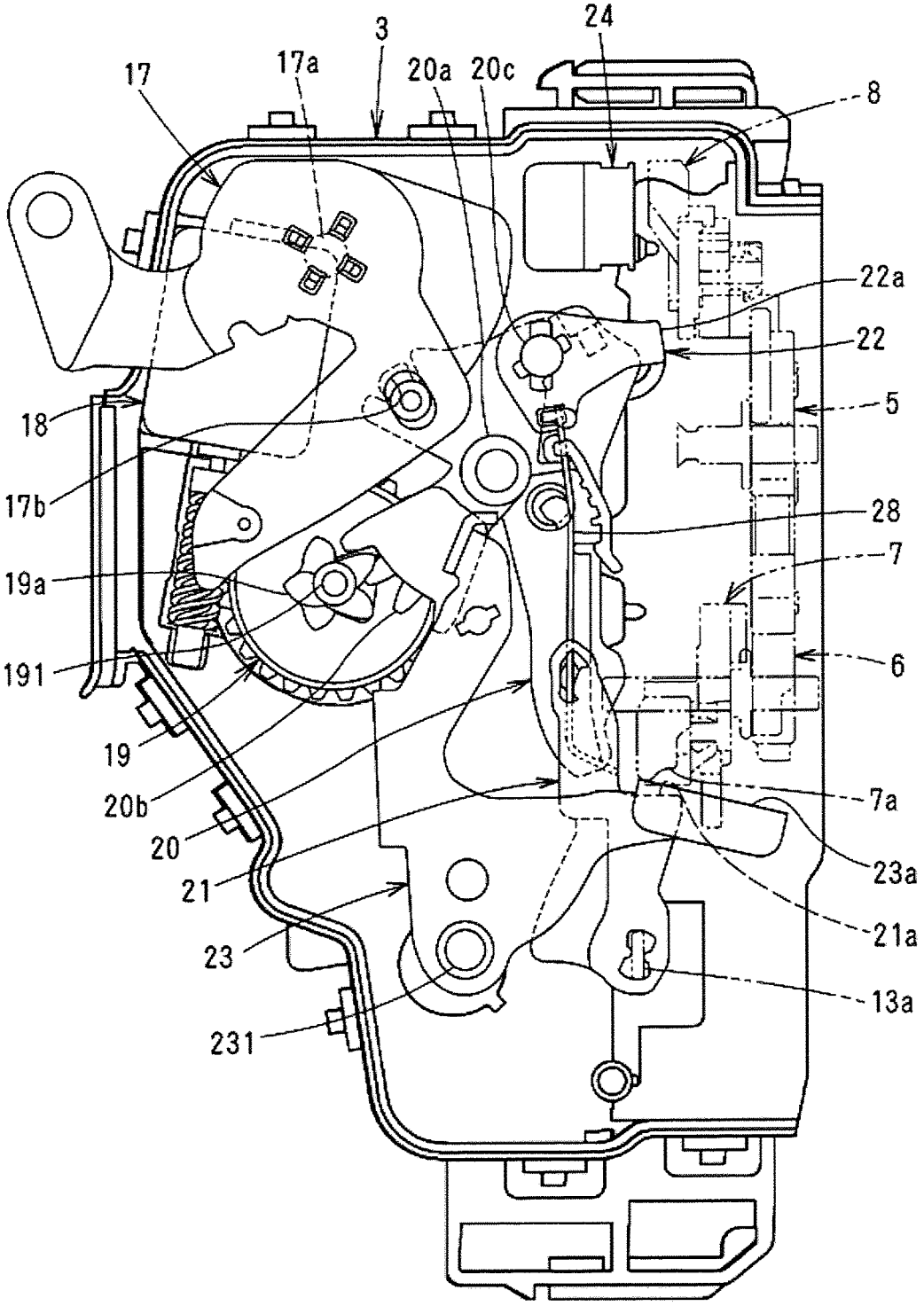
FIG. 11 is a side view of an operation unit.
Figure 12:
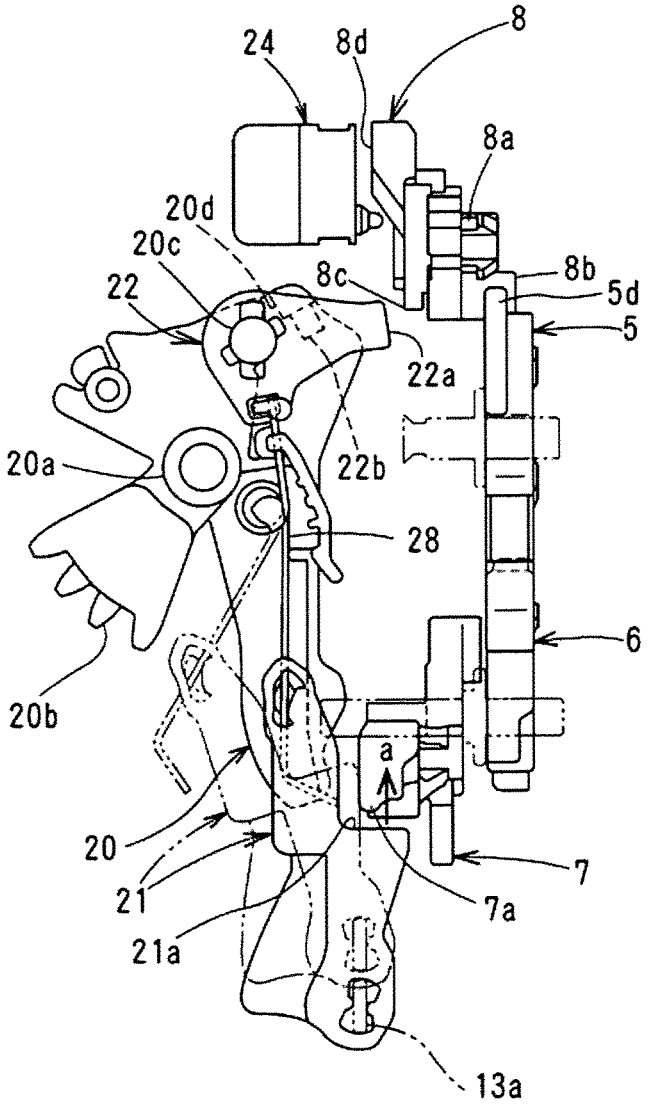
FIG. 12 is a side view of a main part in a case where the latch is at the full latch position and the locking and unlocking mechanism is in the unlocked state.
Figure 13:
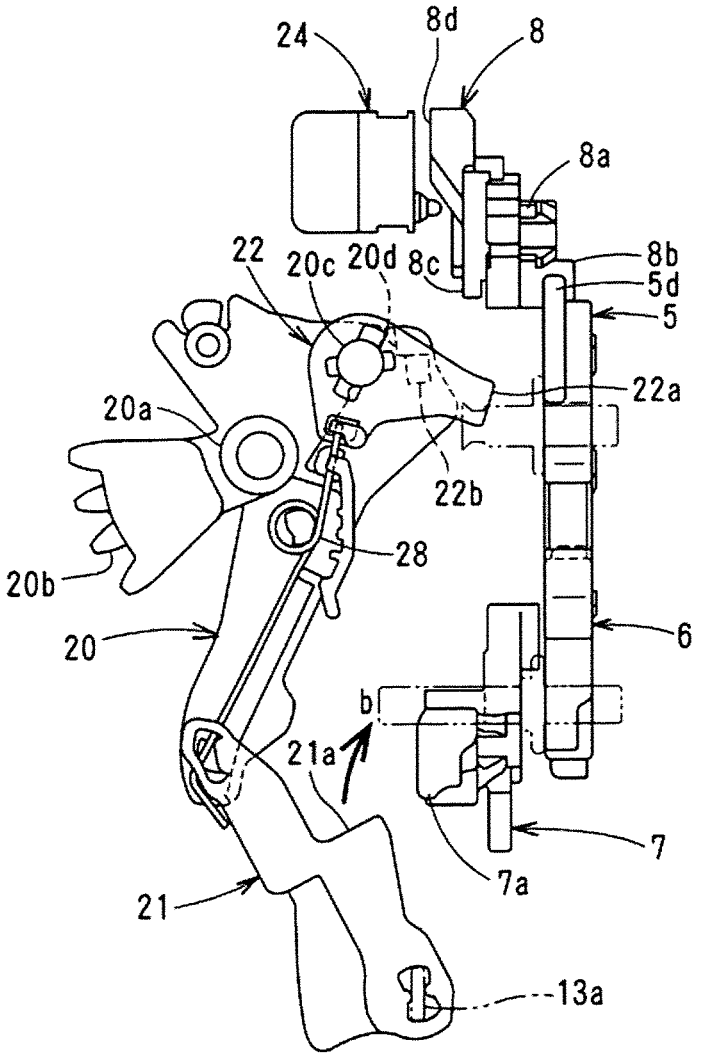
FIG. 13 is a side view of the main part in a case where the latch is at the full latch position and the locking and unlocking mechanism is in the locked state.
Figure 14:
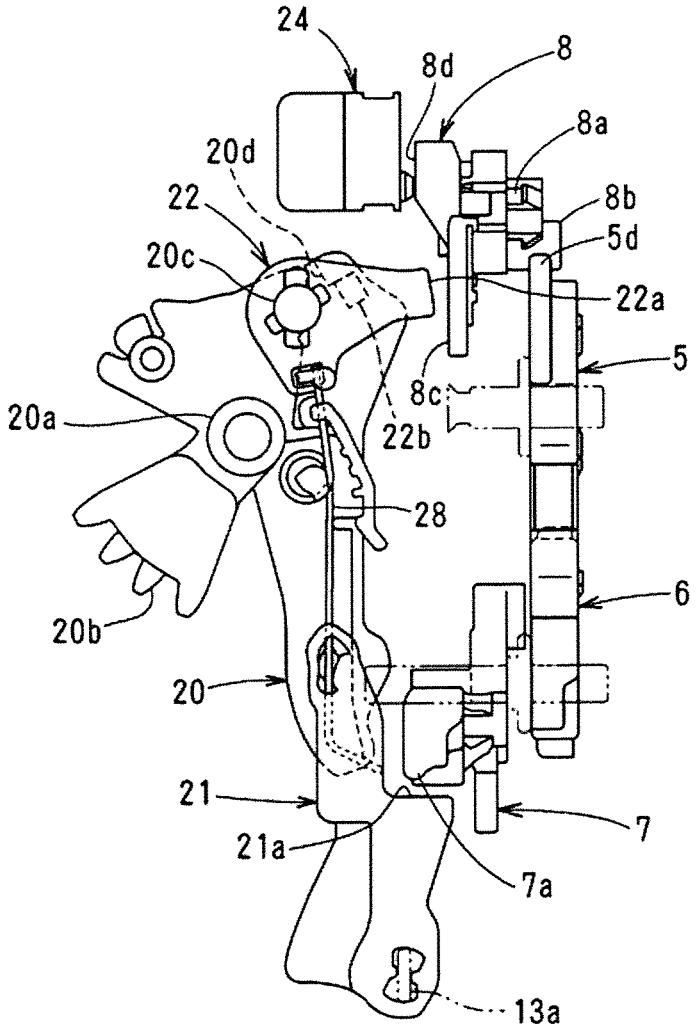
FIG. 14 is a side view of the main part in a case where the latch is at the open position or at the half latch position and the locking and unlocking mechanism is in the unlocked state.
Figure 15:
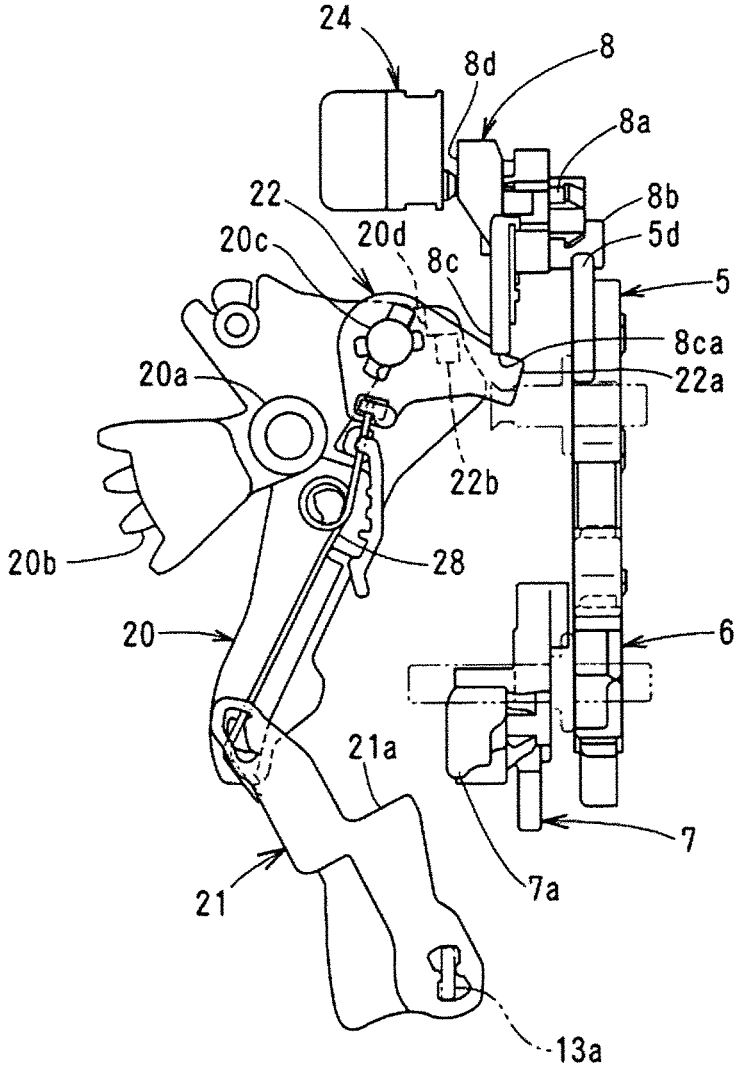
FIG. 15 is a side view of the main part in a case where the latch is at the half latch position and the locking and unlocking mechanism is in the locked state.
Figure 16:
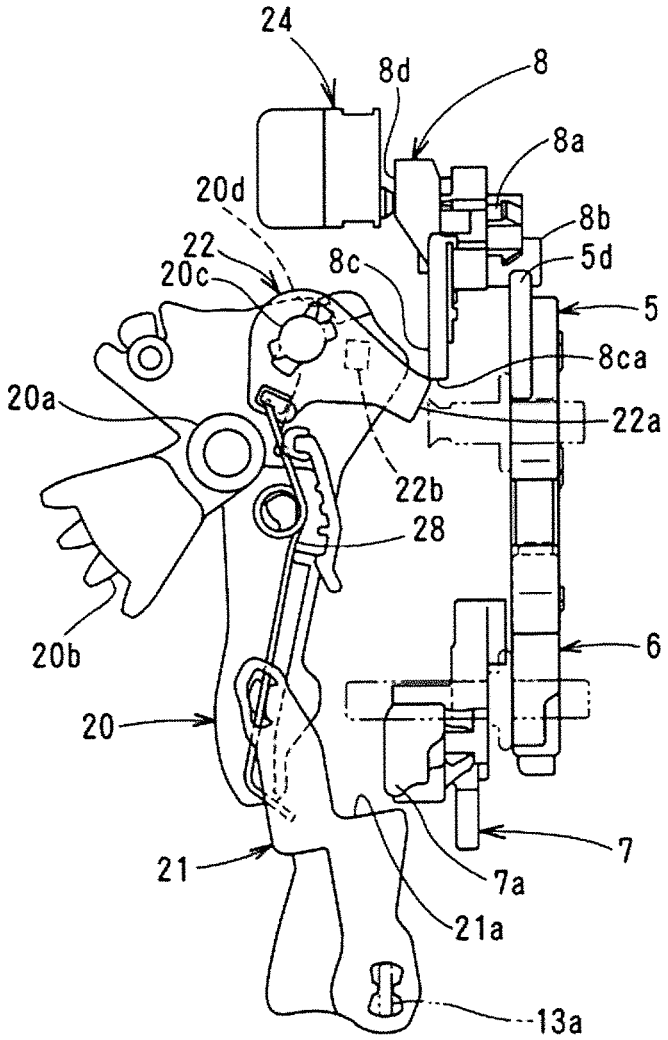
FIG. 16 is a side view of the main part in a case where the latch is at the half latch position and the locking and unlocking mechanism is being switched from the locked state to the unlocked state.

FIG. 11 is a side view of the operation unit. In FIG. 11, illustrations of main cover 14A and sub cover 14B are omitted in order to make locking and unlocking mechanism 40 and other components clearly understandable. FIG. 12 is a side view of the main part in a case where latch 5 is at the full latch position and locking and unlocking mechanism 40 is in the unlocked state. FIG. 13 is a side view of the main part in a case where latch 5 is at the full latch position and locking and unlocking mechanism 40 is in the locked state. FIG. 14 is a side view of the main part in a case where latch 5 is at the open position or the half latch position and locking and unlocking mechanism 40 is in the unlocked state. FIG. 15 is a side view of the main part in a case where latch 5 is at the half latch position and locking and unlocking mechanism 40 is in the locked state. FIG. 16 is a side view of the main part in a case where latch 5 is at the half latch position and locking and unlocking mechanism 40 is being switched from the locked state to the unlocked state.

Details of Operation Unit

Next, operation unit 1B will be described in detail.

First Key Lever and Second Key Lever

As illustrated in FIGS. 3 and 11, first key lever 15 is pivotally supported in the upper portion of operation mechanism housing 3. First key lever 15 is configured such that second key lever 16, which is outside operation mechanism housing 3 and which rotates integrally with first key lever 15, is connected to a key cylinder with a rod, etc. (not illustrated) via operation-force transmitting member 25. In conjunction with a locking and unlocking operation of the key cylinder, first key lever 15 rotates by a predetermined angle, hits locking lever 20, and thereby, rotates locking lever 20.

Knob Lever

As illustrated in FIG. 3, knob lever 17 is pivotally supported by shaft section 17*a* extending toward the vehicle interior direction and the vehicle exterior direction in the inner side surface of sub cover 14B. Knob lever 17 is connected to a lock knob with a Bowden cable etc. (not illustrated) via operation-force transmitting member 26. In conjunction with a locking and unlocking operation of the lock knob, knob lever 17 is located at the unlocked position illustrated in FIG. 11, or is located at the locked position by rotating from the unlocked position, by a predetermined angle, in the counterclockwise direction.

Electric Motor

Electric motor 18 (see FIG. 3) is driven by a remote locking and unlocking operation of the mobile device (not illustrated), so as to rotate worm wheel 19 pivotally supported by shaft 191 in operation housing 3.

Locking Lever

As illustrated in FIG. 3, locking lever 20 is supported in a rotatable manner about shaft section 20*a* by a predetermined angle in operation mechanism housing 3. Locking lever 20 is connected to connection section 15*a* of first key lever 15 and connection hole 17*b* of knob lever 17 (see FIG. 11). On a circumferential edge of locking lever 20, sector gear section 20*b* is provided. The sector gear section 20*b* engages with gear section 19*a* of worm wheel 19.

In the above configuration, as first key lever 15, knob lever 17, or worm wheel 19, locking lever 20 rotates from the unlocked position illustrated in FIG. 11, 12, or 14 to the locked position illustrated in FIG. 13 or 15, which is shifted from the unlocked position by a predetermined angle in the clockwise direction relative to the unlocked position, and also rotates in the opposite direction. When locking lever 20 is rotated by a manual operation, sector gear section 20*b* fails to hit gear section 19*a*. That is, locking and unlocking mechanism 40 of the present embodiment is configured such that rotation of locking lever 20 is not transmitted to electric motor 18, when locking lever 20 is rotated by a manual operation.

Lift Lever

Lift lever 21 has a lower end connected to end 13*a* of outside lever 13 in a swingable manner, and an upper end connected to locking lever 20 in a swingable and vertically movable manner. In conjunction with a locking operation of locking lever 20, lift lever 21 rotates to an unlocked position illustrated in FIGS. 11, 12, and 14, and to a locked position illustrated in FIGS. 13 and 15, which is shifted from the unlocked position in the counterclockwise direction about end 13*a* of outside lever 13 by a predetermined angle relative to the unlocked position. Lift lever 21 moves upward with an opening operation of outside lever 13.

With the above configuration, when lift lever 21 moves upward from the unlocked position, cancel section 21*a* provided at the substantially central portion, in the up/down direction, of lift lever 21 moves in an arrow a direction shown in FIG. 12, to come into contact with cancel receiving section 7*a* of open lever 7 from below. Accordingly, outside lever 13 rotates in the counterclockwise direction when viewed from the front, to rotate ratchet 6 toward a cancel direction. As a result, the interlock between ratchet 6 and latch 5 is canceled. That is, when open lever 7 rotates with rotation of lift lever 21, the door can be opened by a vehicle driver, for example.

In contrast, in a case where lift lever 21 has moved upward from the locked position, lift lever 21 fails to hit cancel receiving section 7*a* of open lever 7 even if cancel section 21*a* moves in an arrow "b" direction illustrated in FIG. 13. In this case, open lever 7 cannot rotate ratchet 6 toward the cancel direction. That is, even when lift lever 21 rotates but fails to hit open lever 7, the door cannot be opened by a vehicle driver, for example.

Inside Lever

As illustrated in FIG. 3, inside lever 23 is pivotally supported by a shaft 231 in the lower portion of operation mechanism housing 3. Inside lever 23 is connected to the inside handle with Bowden cable etc (not illustrated) via operation-force transmitting member 27. Accordingly, in conjunction with the door opening operation of the inside handle (not illustrated), inside lever 23 rotates by a predetermined angle in an open direction (the counterclockwise direction in FIG. 11). In both cases of the unlocked state and the locked state of locking and unlocking mechanism 40, when inside lever 23 rotates in the open direction, cancel section 23*a* provided at an end of inside lever 23 comes into contact with cancel receiving section 7*a* of open lever 7 from below. As a result, inside lever 23 can rotate ratchet 6 in the cancel direction via open lever 7. Accordingly, the door can be opened through rotation of inside lever 23 in the opening direction.

Detection Switch

Figure 9:
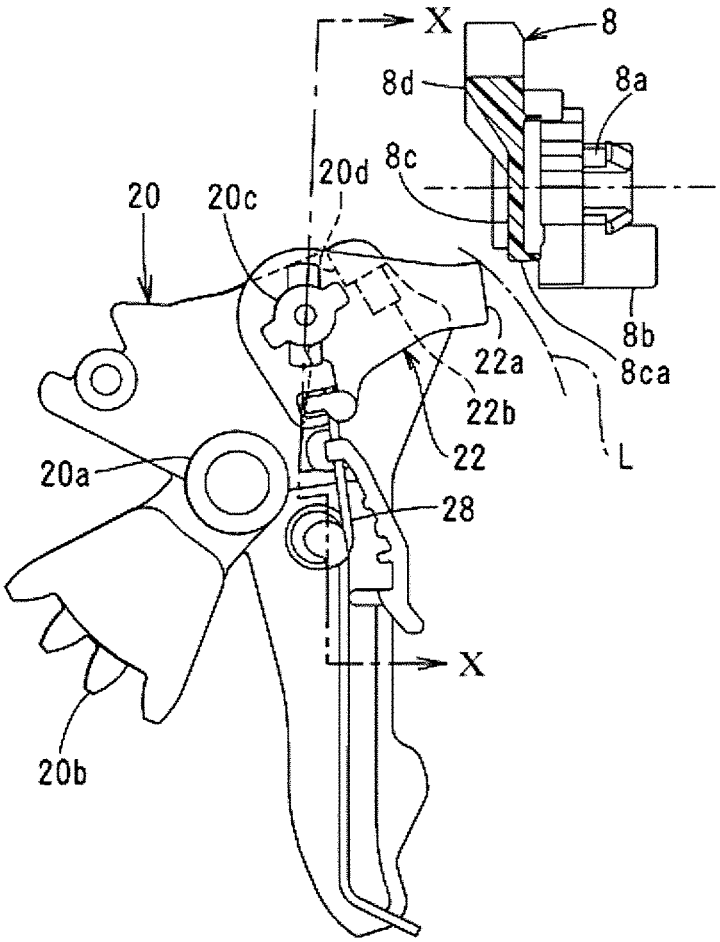
FIG. 9 is a side view of the relationship among the detection lever, the locking lever, and the movable lever.
Figure 10:
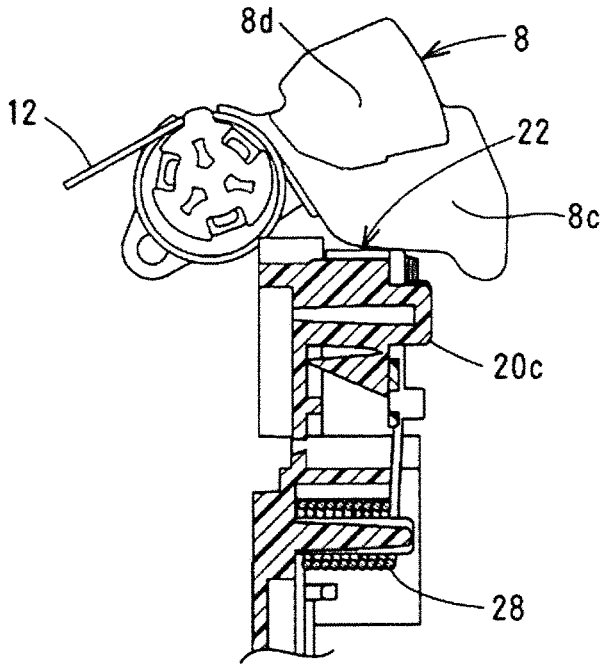
FIG. 10 is a cross sectional view taken along X-X cut line in FIG. 9.

Detection switch 24 (an example of a detection unit) has a function of detecting whether raised section 8*d* of detection lever 8 overlaps movement trajectory L (see FIG. 9). As illustrated in FIG. 3, detection switch 24 is fixed in operation mechanism housing 3. As illustrated in FIGS. 11 to 14, detection switch 24 faces raised section 8*d* of detection lever 8. As illustrated in FIGS. 12 and 13, when detection lever 8 is at a retracted position, in other words, when detection lever 8 does not overlap movement trajectory L, detection switch 24 is separated from (or not in contact with) raised section 8*d*, and thereby, detection switch 24 is turned off. In contrast, as illustrated in FIGS. 14 and 15, when detection lever 8 is at an advanced position, in other words, when detection lever 8 overlaps movement trajectory L, detection switch 24 comes into contact with raised section 8*d*, and thereby, detection switch 24 is turned on. When detection switch 24 detects that detection lever 8 overlaps movement trajectory L, that is, detection switch 24 makes affirmative determination, an indoor light (an example of a notification unit, not illustrated) or the like, for example, is lighted. The indoor light has a function of issuing a notification about a result detected by detection switch 24 in such a way that, when the result is determined as to be affirmative, the indoor light is lit up.

Movable Lever

Movable lever 22 is pivotally supported, in a rotatable manner by a determined angle, by shaft section 20*c* extending in a left/right direction (a direction along the vehicle interior direction or the vehicle exterior direction) relative to the upper portion of locking lever 20 (see FIGS. 3 and 11 to 14). Movable lever 22 is urged by spring 28 (an example of an urging member) supported by locking lever 20, in the counterclockwise direction when viewed from the front. As illustrated in FIGS. 12 to 15, as a result of portion 22*b* of movable lever 22 rotating and coming into contact with stopper section 20*d* of locking lever 20, movable lever 22 is held at a position (a normal position) at which rotation of movable lever 22 in the counterclockwise direction is restricted.

With the above configuration, movable lever 22 moves about shaft section 20*a* with rotation of locking lever 20, while being held at the normal position by the urging force of spring 28.

Spring

As illustrated in FIGS. 3, 14, and 15, when the upper end of spring 28 is locked to movable lever 22, spring 28 applies an urging force to movable lever 22 toward the normal position. When an unlocking operation is performed immediately after a door opening operation while the door is in the fully-closed state and the locking and unlocking mechanism is in the locked state, the lower end of spring 28 is locked to lift lever 21 and spring 28 applies an urging force to lift lever 21 in the clockwise direction about end 13*a* of outside lever 13. The reason why spring 28 applies the urging force to lift lever 21 is to avoid a panic state in the case where an unlocking operation is performed immediately after a door opening operation while the door is in the fully-closed state and the locking and unlocking mechanism is in the locked state. The urging force of spring 28 is weaker than the urging force of the spring (not illustrated) for elastically holding locking lever 20 at the unlocked position or the locked position.

Operations and Effects

Next, specific operations and effects of vehicular door latch device 1 of the present embodiment will be described with reference to the drawings.

Here, a simple description will be given of avoidance of the aforementioned panic state, with reference to FIGS. 12 and 13. First, in the locked state illustrated in FIG. 13, locking lever 20 moves toward the unlocked position by a door opening operation of the outside handle (not illustrated) while lift lever 21 has upwardly moved. As a result, as indicated by the two-dot chain line in FIG. 12, while lift lever 21 has ridden on the front surface of cancel receiving section 7*a* of open lever 7 and is inhibited from moving to the unlocked position, only locking lever 20 moves to the unlocked position against the urging force of spring 28. When the outside handle (not illustrated) returns to the original position and lift lever 21 moves downward, locking lever 20 comes off the front surface of open lever 7 and moves to the unlocked position by the urging force of spring 28. In this way, even when the panic state has occurred, locking and unlocking mechanism 40 of the present embodiment enables easy switching from the locked state to the unlocked state, by temporarily stopping the door opening operation of the outside handle and restoring outside lever 13 to the initial position.

When detection lever 8 is at the retracted position, inhibiting section 8*c* of detection lever 8 is retracted at a position outside movement trajectory L of movable lever 22 (see FIGS. 6, 7, 12, and 13). Thus, detection lever 8 does not influence movement of locking lever 20 from the unlocked position to the locked position.

However, when detection lever 8 is at the advanced position, inhibiting section 8*c* of detection lever 8 has advanced in movement trajectory L of movable lever 22 that is at the normal position (see FIGS. 4, 5, and 14). Thus, when movement of locking lever 20 from the unlocked position to the locked position is attempted, contact section 22*a* comes into contact with inhibiting section 8*c* of detection lever 8, and thus, contact section 22*a* (movable lever 22) inhibits locking lever 20 from moving from the unlocked position to the locked position (switching of the locking and unlocking mechanism from the unlocked state to the locked state). In other words, in vehicular door latch device 1 of the present embodiment, when the door is open, switching of the locking and unlocking mechanism from the unlocked state to the locked state is inhibited.

FIG. 15 illustrates an abnormal state where, when, for example, a driver is trying to close the door, locking and unlocking mechanism 40 is switched to the locked state by a locking operation through the mobile device, etc. at almost the same time as latch 5 reaches the full-latch closer side region of the half latch region, but the door does not enter the fully-closed state but enters the half-closed state, for example. In the structure of vehicular door latch device 1, the abnormal state occurs due to the positional relationship in which inhibiting section 8*c* of detection lever 8 is retracted to the outside of movement trajectory L of movable lever 22 while latch 5 is in the full-latch closer side region in the half latch region.

In the vehicular door latch device (not illustrated) disclosed in the aforementioned publication, when the above abnormal state has occurred, the detection lever is shifted to the advanced position while the locking lever is at the locked position, so that the locking lever is restricted at the locked position. Therefore, in the vehicular door latch device disclosed in the aforementioned publication, the locking lever cannot be moved from the locked position to the unlocked position when the abnormal state has occurred.

However, when the abnormal state has occurred in vehicular door latch device 1 of the present embodiment as illustrated in FIG. 15, detection lever 8 moves relative to locking lever 20 (locking and unlocking mechanism 40) against the urging force of spring 28, in an escape direction (for example, the clockwise direction in FIG. 15) so as not to inhibit movement of locking lever 20 from the locked position to the unlocked position. Accordingly, vehicular door latch device 1 of the present embodiment can move locking lever 20 from the locked position to the unlocked position in the abnormal state.

That is, in the abnormal state illustrated in FIG. 15, an unlocking operation is performed on vehicular door latch device 1 of the present embodiment, through the lock knob, the key cylinder, the mobile device, or the like, and an operation force is applied to locking lever 20 in the unlocking direction. Accordingly, movable lever 22 rotates, with movement of locking lever 20 from the locked position toward the unlocking direction, from the normal position illustrated in FIG. 15, toward the escape direction (the clockwise direction in FIG. 15), against the urging force of spring 28, while remaining in contact with edge 8*ca* of inhibiting section 8*c* of detection lever 8. In other words, in the abnormal state, the upper surface (the inclined surface) of movable lever 22 is in contact with detection lever 8, movable lever 22 slides relative to detection lever 8, and thereby, the posture change is achieved. The postures of detection lever 8 and movable lever 22 are changed from those illustrated in FIG. 15 to those illustrated in FIG. 16.

As a result, locking lever 20 can move from the locked position to the unlocked position without being interrupted by detection lever 8. After locking lever 20 has moved to the unlocked position, movable lever 22 returns to the normal position by the urging force of spring 28 (in other words, restores the normal posture), and thereby, movement of locking lever 20 to the locked position is inhibited. After movement of locking lever 20 to the unlocked position, a driver, for example, can open the door by performing a door opening operation on the outside handle or the inside handle.

The specific embodiment of the present disclosure has been exemplified above. However, the scope of the claims of the present invention is not limited to the above specific embodiment. The scope of the claims of the present invention encompasses the following embodiment, for example.

In the above embodiment, the example is given in which detection lever 8 is provided with inhibiting section 8*c* that inhibits a switching operation of the locking and unlocking mechanism from the unlocked state to the locked state, but the scope of the claims of the present invention is not limited thereto.

For example, another inhibiting section for inhibiting the switching operation of the locking and unlocking mechanism from the unlocked state to the locked state is provided to latch 5. When latch 5 is in the open region or the half-latch closer side region of the half latch region, the inhibiting section of latch 5 advances into movement trajectory L of contact section 22*a* of movable lever 22, to inhibit switching of the locking and unlocking mechanism from the unlocked state to the locked state. Alternatively, when latch 5 is in the full-latch closer side region of the half latch region or the full latch position, the inhibiting section of latch 5 is retracted to the outside of movement trajectory L, to permit switching of the locking and unlocking mechanism from the unlocked state to the locked state. In this case, detection lever 8 is not a required component.

What is claimed is:

1. A vehicular door latch device comprising:

a latch having an engagement groove that is inwardly recessed from an outer circumference of the latch, a full latch interlock section and a half latch interlock section that are both formed on the outer circumference of the latch, wherein the latch rotates in accordance with opening and closing of a door;

a striker provided in a vehicle body that engages with the engagement groove;

a ratchet that is disposed to be in contact with the latch, wherein the ratchet interlocks with the full latch interlock section and holds the latch in a first posture when the door is in a fully-closed state, and the ratchet interlocks with the half latch interlock section and holds the latch in a second posture when the door is in a half-closed state; and an operation unit, said operation unit comprising a locking and unlocking mechanism whose posture is switched between an unlocked posture in which interlock between the latch and the ratchet can be canceled and a locked posture in which the interlock cannot be canceled, through posture change of the locking and unlocking mechanism caused by an operation of the operation unit; and a detection lever being in contact with the outer circumference of the latch and being configured to retract from a movement trajectory of the locking and unlocking mechanism so as to permit the locking and unlocking mechanism to be switched from the unlocked posture to the locked posture when the latch is in the first posture, and to enter the movement trajectory of the locking and unlocking mechanism so as to prohibit the posture change of the locking and unlocking mechanism by blocking the locking and unlocking mechanism when the latch is in the second posture, wherein the locking and unlocking mechanism comprises a movable lever being configured to, when the locking and unlocking mechanism is in the locked posture while the latch is not in the first posture, come into contact with the detection lever that enters the movement trajectory of the locking and unlocking mechanism, and to rotate such that the locking and unlocking mechanism is switched to the unlocked posture.

2. The vehicular door latch device according to claim 1, wherein:

the locking and unlocking mechanism comprises a spring that biases the movable lever against the detection lever, and when the movable lever comes into contact with the detection lever that enters the movement trajectory of the locking and unlocking mechanism, the movable lever rotates in a direction away from the detection lever against a biasing force of the spring.

3. The vehicular door latch device according to claim 2, wherein when the locking and unlocking mechanism is switched from the locked posture to the unlocked posture, the movable lever is configured to rotate back by the biasing force of the spring.

4. The vehicular door latch device according to claim 2, wherein the locking and unlocking mechanism further comprises a locking lever that holds the movable lever, and the movable lever is supported by a shaft section in such a manner as to rotate by a predetermined angle relative to the locking lever.

5. The vehicular door latch device according to claim 1, wherein:

the latch comprises a recessed and protruding section on the outer circumference, wherein the recessed and protruding section includes a protruding section protruding outwardly and a recessed section adjacent to the protruding section and the recessed and protruding section comes into contact with the detection lever, the detection lever is provided with a sliding section which comes into contact with the recessed and protruding section at one end of thereof, an inhibiting section at the other end thereof and a shaft section interposed between the sliding section and the inhibiting section to pivotally support thereof, and the vehicular door latch device is configured such that, when the latch is in the first posture, the sliding section comes into contact with the recessed section in order to retract the inhibiting section from the movement trajectory, and when the latch is in the second posture, the sliding section comes into contact with the protruding section in order to cause the inhibiting section to enter the movement trajectory.

6. The vehicular door latch device according to claim 1, wherein the locking and unlocking mechanism is formed of a link mechanism.

7. The vehicular door latch device according to claim 1, further comprising:

a detection unit that detects whether the detection lever is in the movement trajectory; and a notification unit that issues, when a result detected by the detection unit is determined to be affirmative, a notification about the result.

* * * * *